United States Patent [19]

Logan

[11] 3,973,286

[45] Aug. 10, 1976

[54] FOOT CLEANING APPARATUS HAVING SOAP SUPPLY AND BRUSHING MEANS

[75] Inventor: Corrigan D. Logan, Tuscaloosa, Ala.

[73] Assignee: Logan Enterprises Inc., Demopolis, Ala.

[22] Filed: Jan. 22, 1975

[21] Appl. No.: 543,160

[52] U.S. Cl. ..... 15/21 D; 4/158; 15/34; 15/104.92

[51] Int. Cl.[2] ..... A47K 7/03; A61H 33/00

[58] Field of Search ..... 15/21 D, 31, 34, 36, 15/97 A, 104.92, 112, 161, 215, 216; 4/158, 182, 184; 128/56, 57, 65, 25 B

[56] References Cited

UNITED STATES PATENTS

| | | | |
|---|---|---|---|
| 424,867 | 4/1890 | Eggert | 15/36 |
| 984,640 | 2/1911 | Aronis | 15/161 |
| 1,471,826 | 10/1923 | Bzowy | 15/36 |
| 2,325,843 | 8/1943 | Finley | 15/31 X |
| 2,385,511 | 9/1945 | Hays et al. | 15/21 D |
| 2,988,754 | 6/1961 | Misson | 4/182 |
| 3,102,290 | 9/1963 | Sannes | 15/21 D X |
| 3,359,572 | 12/1967 | Blackwell | 4/182 |
| 3,548,439 | 12/1970 | Berst | 15/104.92 |
| 3,550,176 | 12/1970 | Dejesa | 15/21 D |

FOREIGN PATENTS OR APPLICATIONS

| | | | |
|---|---|---|---|
| 637,970 | 3/1962 | Canada | 15/31 |

*Primary Examiner*—Daniel Blum

*Attorney, Agent, or Firm*—Lowe, King, Price & Markva

[57] ABSTRACT

A foot to be cleaned is placed on a treadle in a housing. In response to depression of the treadle, a bellows is pressurized causing a foot cleaning solution to be dispensed from the bellows to a conduit. A port in the conduit is positioned above a pair of horizontally disposed, rotatable brushes that are located beyond the forward end of the treadle. In response to the treadle being depressed by the heel of the foot, the bellows is compressed and the solution is dispensed through the port onto the foot via an obstructed flow path. The brushes are positioned so that the toes of the foot being cleaned can be inserted through a gap between the brushes. The gap is approximately horizontally aligned with the upper surface of the treadle.

6 Claims, 7 Drawing Figures

FOOT CLEANING APPARATUS HAVING SOAP SUPPLY AND BRUSHING MEANS

FIELD OF THE INVENTION

The present invention relates to foot cleaning apparatus and more particularly to a foot cleaning apparatus wherein a cleaning solution is dispensed in response to the foot being cleaned depressing a treadle.

BACKGROUND OF THE INVENTION

Many persons find it difficult to clean their feet properly for various reasons. The difficulty is accented because of the high frequency with which many persons take showers, rather than baths. To wash the feet properly in a shower, it is necessary either to bend on one knee or to stand on one leg. Persons who are not ambulatory or physically incapacitated, because of age, infirmity or pregnancy, find it particularly difficult to wash their feet under almost all circumstances. It is dangerous for all persons to stand with one leg while showering. While numerous devices have been proposed to wash the feet, I am unaware of any device that has been commercially exploited. Apparently, the proposed devices of the prior art have been overly expensive or have not been designed to do the job adequately.

BRIEF DESCRIPTION OF THE INVENTION

In accordance with one aspect of the present invention, a foot cleaning apparatus is provided wherein a treadle is located in a housing and the foot to be cleaned is placed on the treadle. In response to depression of the treadle, a bellows containing a foot cleaning solution is pressurized and the solution dispensed into the housing so that it is applied to the foot. Brush means in the housing scrub the foot so that the dispensed cleaning solution is rubbed against the foot to clean it. Preferably, the brush means includes a pair of mating, horizontally disposed rotatable brushes positioned in the housing beyond a forward end of the treadle. The toes of the foot to be cleaned are inserted between the brushes to form a gap in the brushes. As the toes are inserted into the gap, at least one of the brushes rotates about a horizontal axis to facilitate the scrubbing action. The gap is approximately horizontally aligned with the upper surface of the treadle so that the toes can be inserted between the brushes while remaining in a natural position. The pressurized bellows supplies the cleaning solution to a conduit extending from the bottom of the bellows. The conduit terminates in a port that is positioned above both brushes and faces toward the rear of the treadle so that an unobstructed flow path is provided between the port and the foot of the treadle. The bellows serves as a reservoir for the cleaning solution and causes the solution to be pumped through the conduit in response to depression of the treadle by the heel of the foot being cleaned. Pumping is augmented by a seal formed between the upper edge of the bellows and the underneath surface of the treadle.

The cleaning solution may be formed by water in the basin mixing with bar or powdered soap in the bellows. The bellows is secured to the interior floor of the basin and water that enters the bellows from the basin through a check valve at the bottom of the bellows. The check valve is biased so that water flows into the bellows from the basin while the bellows is in an uncompressed state. In response to the bellows being compressed by the heel pressing against the heel portion of the treadle, increased air pressure in the interior of the bellows forces the check valve against the bellows wall and causes the cleaning solution in the bellows to be forced through the conduit. Alternatively, liquid soap can be stored in the bellows and can be mixed with water or can be pumped without mixing; in the latter case no water would flow into the bellows.

As a further feature, the upper surface of the treadle is formed of a bristly material, such as Astro Turf, to provide a brushing action against the bottom of the foot.

The horizontally rotatable brushes and the treadle are easily removed to facilitate cleaning thereof and the interior of the housing.

The apparatus is preferably utilized in a shower, whereby water collects in a basin at the bottom of the housing and can flow into the bellows. The bottom, exterior surface of the housing is provided with suction cups to prevent slippage of the housing in the shower.

It is, accordingly, an object of the present invention to provide a new and improved foot cleaning apparatus.

Another object of the invention is to provide a new and improved foot cleaning apparatus that is particularly adapted to be utilized in a shower.

A further object of the invention is to provide a new and improved, inexpensive foot cleaning device that is particularly suited to clean between the toes.

A further object of the invention is to provide a new and improved foot cleaning apparatus wherein the foot being cleaned is maintained in a horizontal position against a relatively stable platform or treadle.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 1:
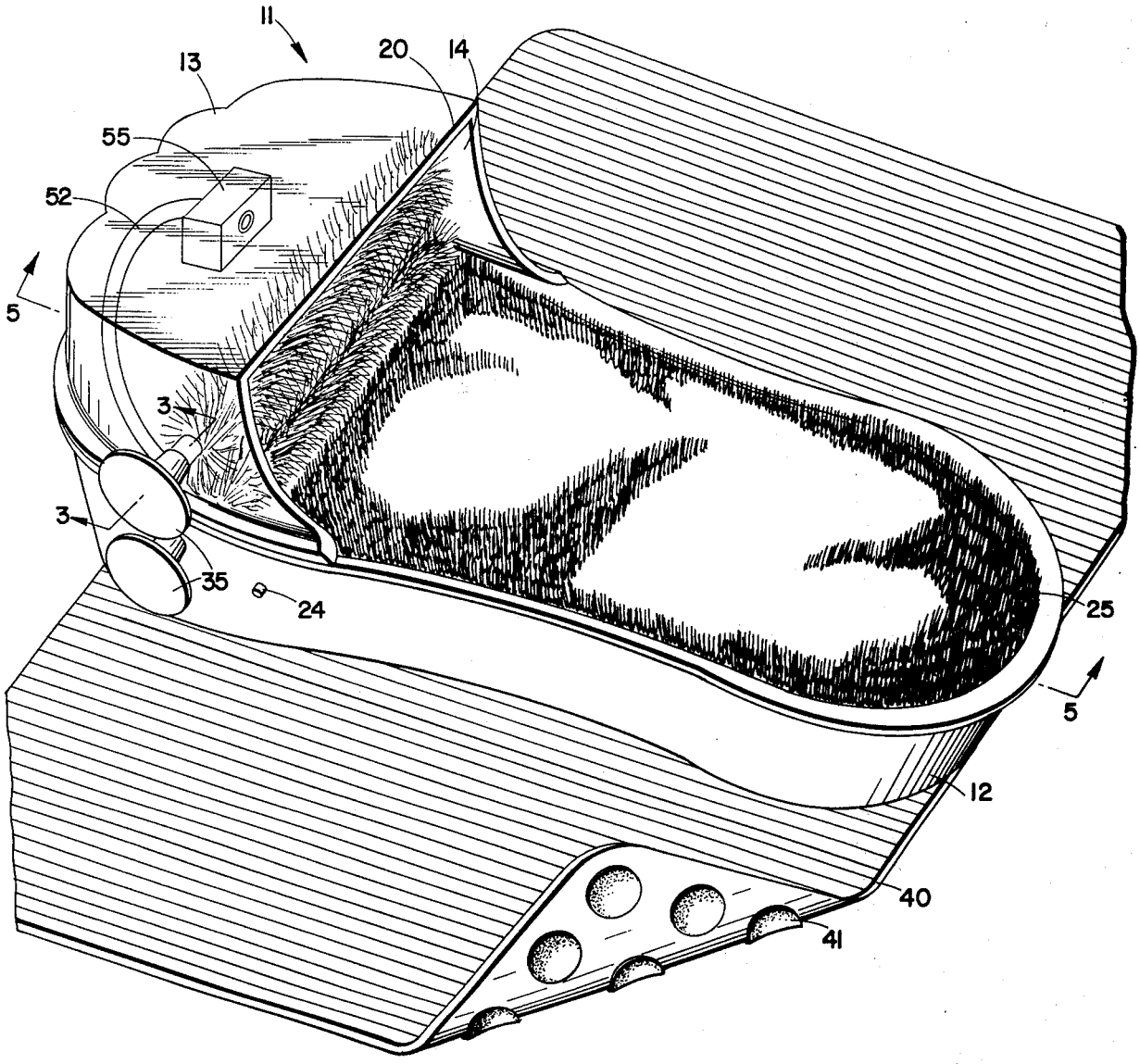
FIG. 1 is a perspective view of a preferred embodiment of the invention wherein a treadle is in the usual horizontal position.
Figure 3:
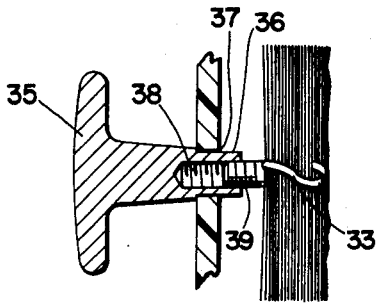
FIG. 3 is a sectional view taken through the lines 3–3 (FIG. 1) wherein there is illustrated a removable connection for a brush positioned forward of the treadle.
Figure 2:
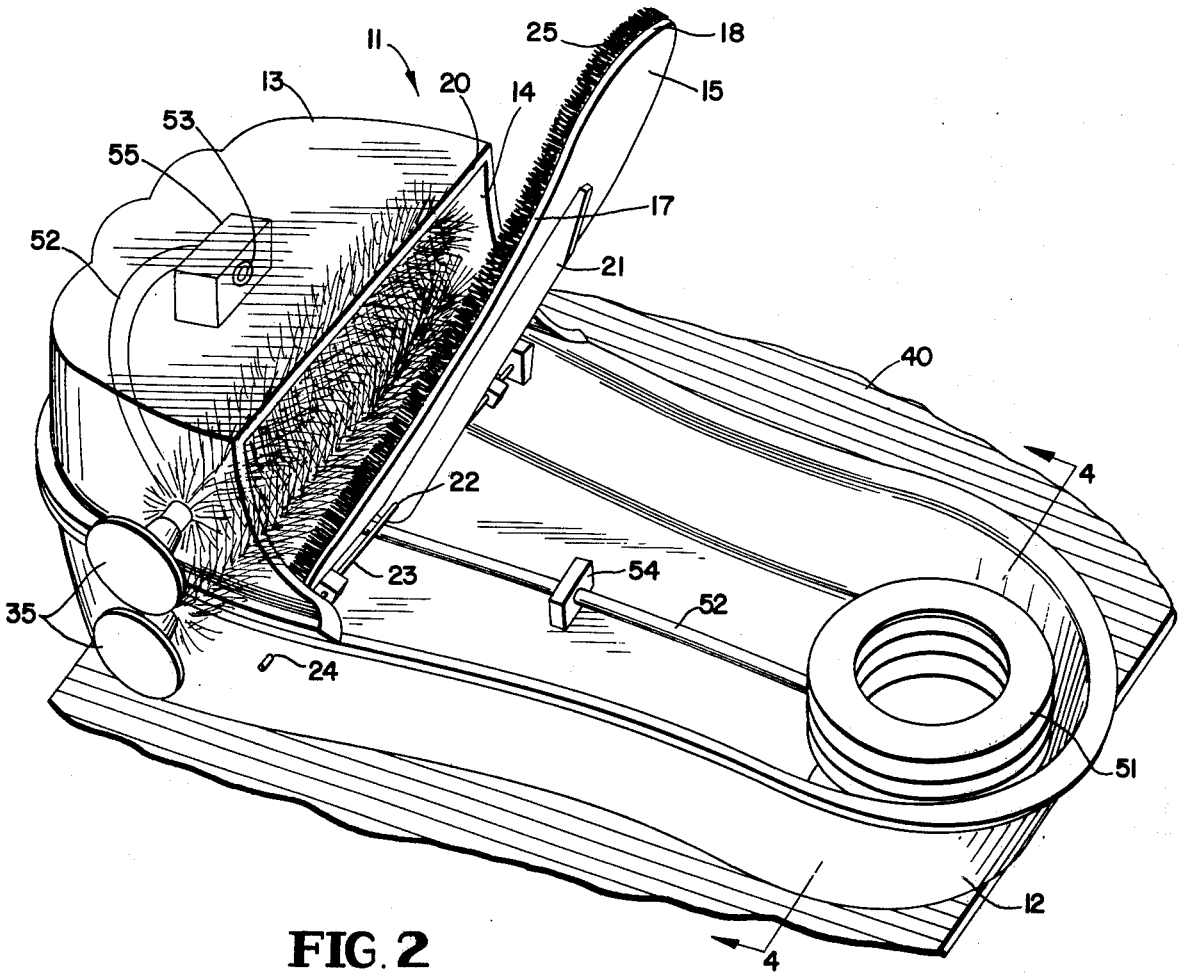
FIG. 2 is a further perspective view wherein the treadle is illustrated as being in a relatively upright position.
Figure 4:
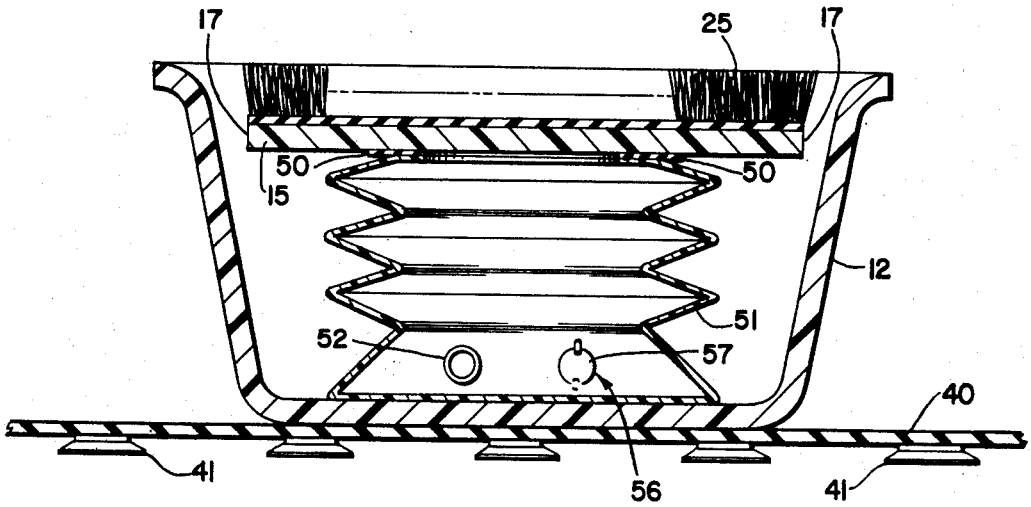
FIG. 4 is a sectional view taken through the lines 4—4 (FIG. 2) wherein there is illustrated the relative position of a bellows, the treadle and a basin.
Figure 5:
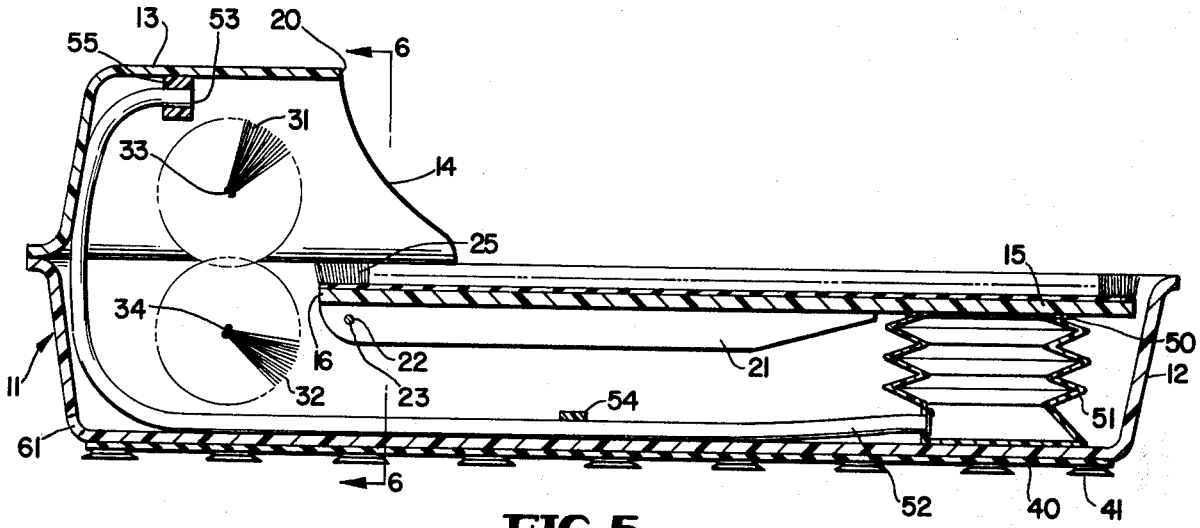
FIG. 5 is a side sectional view taken through the lines 5—5 (FIG. 1)
Figure 6:
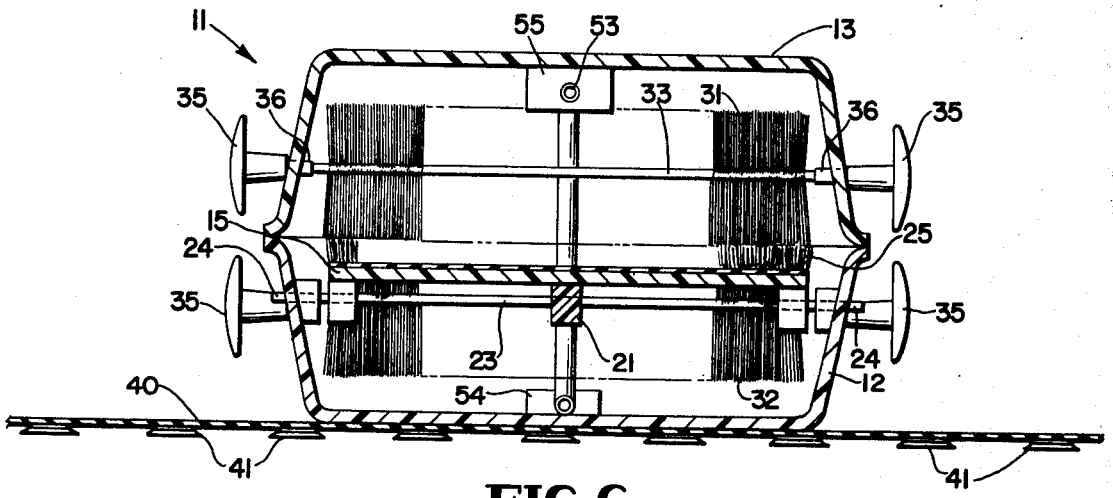
FIG. 6 is a sectional view taken through the lines 6—6 (FIG. 5)
Figure 7:
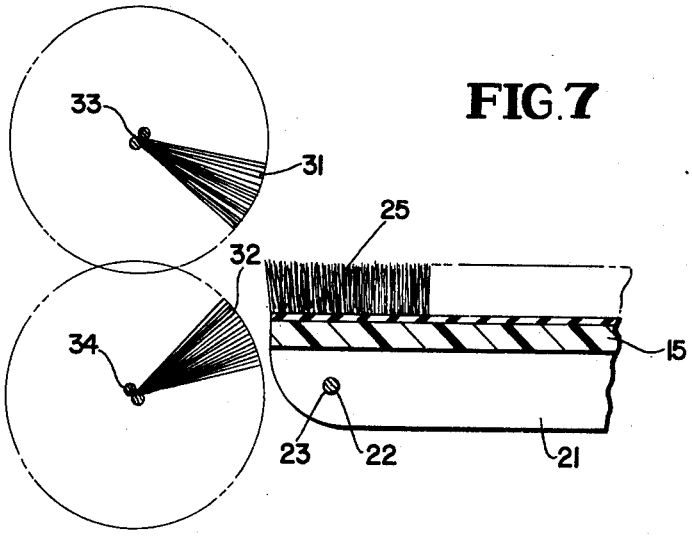
FIG. 7 is an enlarged view illustrating the relative position of the treadle and brushes.

Reference is now made to the drawing wherein there is illustrated a molded plastic housing 11 having the general shape and size of the foot of a person; typically, the housing is approximately 13½ inches long, 8 inches wide and 6 inches high. Housing 11 includes a lower or basin portion 12 that is integral with an upper hood portion 13. Hood portion 13 extends over the forward end of basin portion 12 and includes a generally vertically extending opening 14 through which the toes of a foot being cleaned can extend. Positioned in the portion of basin 12 to the rear of hood portion 13 is a horizontally extending, plastic treadle 15 having a straight forward edge 16, as well as side and heel edges 17 and 18 that generally resemble the outline of a foot between the ball and heel. Edges 17 and 18 of treadle 15 conform generally with the upper edges of basin 12 into which the treadle fits. Edge 16 extends parallel to the rear, straight edge 20 of hood portion 13 and is positioned slightly in front of edge 20.

Treadle 15 is pivotable about a horizontal axis that extends parallel to edge 16 and lies in approximately the same vertical plane as edge 20. To this end, treadle 15 includes a downwardly depending longitudinally extending strengthening rib 21 having a horizontally disposed bore 22 adjacent its forward end. Extending horizontally through bore 22 is shaft 23 that is captured in bores 24 adjacent the top edge of basin 12, near its intersection plane with hood 13. Shaft 23 is slidable with respect to bores 22 and 24 enabling the shaft to be removed from the bores, whereby treadle 15 can be removed from the remainder of housing 12 for cleaning purposes. Secured to the upper surface of treadle or platform 15 is a bristly material, such as a nylon carpet 25, that is preferably formed of Astro Turf and has the same shape and size as the treadle. Carpet 25 functions as a scrubbing surface for the bottom of the foot being cleaned. The heel of treadle 15 is supported by bellows 51 that also dispenses a cleaning solution, as described infra.

Positioned immediately forward of edge 16 is a toe or digit brushing means including horizontally disposed rotatable roller brushes 31 and 32. Brushes 31 and 32 are respectively mounted on horizontally extending shafts 33 and 34 so that the horizontal peripheral edges of the brushes are in contact. The contact region between brushes 31 and 32 lies in a horizontal plane that is approximately coincident with the upper surface of treadle 15. Thereby, when a foot being cleaned is placed on treadle 15, the toes of the feet naturally extend into a gap formed between the peripheral edges of brushes 31 and 32 without an unnatural deflection of the toes. As the foot is moved back and forth on treadle 15, brushes 31 and 32 rotate about shafts 33 and 34 thereby cleaning the toes, the toenails and the regions between the toes.

Brushes 31 and 32 are easily removed from housing 11 to facilitate cleaning thereof by releasably mounting shafts 33 and 34 on knobs 35. Each of knobs 35 includes a stub shaft 36 that extends through a horizontally extending bore 37 in housing 11. A threaded bore 38 is provided in the end of stub shaft 36 that extends through bore 37 and mates with threads 39 at the ends of shafts 33 and 34. Each of shafts 33 and 34 has a length that is less than the distance between the interior sidewalls of housing 11 between opposite bores 37 in the sidewalls of the housing. Thereby, in response to rotation of knobs 35 so that shafts 33 and 34 are unthreaded from bores 38, brushes 31 and 32 drop to the interior floor of basin 12 and are easily removed.

Cleaning solution for the foot being cleaned is dispensed by the apparatus of the present invention in response to depression of treadle 15 by the heel of the foot. To this end, a reservoir formed by a plastic bellows 51, is secured to the interior floor of basin 12 toward the rear of the basin. The upper end of bellows 51 is provided with a lip 50 that forms a seal against the underneath surface of treadle 15 when the treadle is in its normal position, rotated clockwise about shaft 23. Lip 50 also supports the heel portion of treadle 15 to normally maintain the treadle in the horizontal plane, parallel to the floor of basin 12. Plastic conduit 52 passing through guide 54 is connected to the interior of bellows 51 through an aperture in the bottom of the bellows so that a cleaning solution in the bellows is forced through the conduit in response to depression of treadle 15 by the heel which causes compression of the bellows. The cleaning solution flows through conduit 52 to port 53 at the end of conduit 52 remote from bellows 51. Port 53 supported by block 55 is located above the upper periphery of brush 31 and is positioned so that it faces rearwardly of housing 11. Thereby an unobstructed flow path is provided between port 53 and a foot being cleaned that rests on treadle 15. In the alternative, the cleansing solution can be dispensed against brushes 31 and 32, by suitable positioning of port 53. Conduit 52 is held in situ by lug 54 that is secured to the interior of basin 12, as well as by a lug 55 that extends downwardly from the interior surface of hood 13. To minimize the flow impedance through conduit 52 between reservoir or bellows 51 and port 53, the conduit extends upwardly from the floor of basin 12 in proximity to the ceiling of hood 13 by a gently curving path having no kinks or sudden bends.

The foot cleaner of the present invention is advantageously utilized in a shower and is placed on the floor of the shower basin. To prevent slipping of the housing while it is in the shower and water is flowing along the floor of the shower basin, the bottom exterior of basin 12 has secured thereto a flexible mat 40 including a number of molded suction cups 41 on its bottom. Mat 40 extends on both sides of housing 11 and is sufficiently wide and long to enable a foot to be placed on it. Thereby, a stabilizing foot, not being cleaned can be firmly placed on the mat, to obviate the possibility of a user slipping as he moves the foot being cleaned on carpet 25. To provide drainage of shower water after the apparatus has been used and prevent accumulation of excessive shower water while the apparatus is in use, a port 61 is provided at the forward end of basin 12, in the floor of the basin. Housing 11 is preferably placed on the floor of the shower stall so the heel of the housing is slightly above the forward end to assure the flow of water into bellows 51.

When the invention is utilized in a shower or the like, the bottom of basin 12 fills with water to a certain extent. The cleansing solution is comprised of an aqueous solution derived from powder or bar soap that is placed in bellows 51 and mixes with water that flows into the bellows. Water flows into bellows 51 from the bottom of basin 12 through port 56 in the sidewall of the bellows, proximate the lower edge of the bellows. Preferably, the water flows into bellows 51 through port 56 via a check valve 57 that is formed as a lightweight, plastic wafer 57 hingedly mounted on the interior sidewall of bellows 51 to enable port 56 to be covered. In response to water being in the basin 12 above or at the level of port 56, water flows into the interior of bellows 51 and mixes with the cleansing agent located therein to form a cleansing solution while the bellows is in an uncompressed state. In response to the heel of the foot being cleaned pressing down on the heel portion of treadle 15, the interior of bellows 51 is pressurized, causing wafer 57 to be urged against the sidewall of bellows 51 whereby port 56 is closed. In response to the increased fluid pressure inside the bellows 51, the cleansing solution is forced through conduit 52 to port 53 and squirts out of the port against the foot.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. Foot cleaning apparatus comprising a housing for receiving the foot to be cleaned, a treadle in said housing on which the foot is adapted to be placed, means in said housing responsive to depression of the treadle for pressurizing a foot cleaning solution, means responsive to the solution being pressurized for dispensing the solution into the housing so that the dispensed solution is applied to the foot, and brush means in the housing for scrubbing the foot so that the dispensed cleaning solution is rubbed against the foot; wherein the pressurizing means includes a bellows and the dispensing means includes conduit means connected to the bellows, said bellows serving as a reservoir for the solution and being positioned so that depression of the treadle causes compression of the bellows and air pressure to be applied to the solution therein, whereby the solution flows through the conduit means to clean the foot; wherein the housing has a floor for holding liquid, said bellows being secured to the interior portion of the floor of the housing and having an upper edge in sealing arrangement with an underside of the treadle, and a check valve in the bottom of the bellows for enabling the liquid held in the housing to flow into the bellows while the bellows is uncompressed and for blocking the flow of liquid out of the bellows into the housing when the air pressure is increased in the bellows; wherein said brush means includes a brush positioned in the housing adjacent a forward end of the treadle to clean the toes, said treadle being pivotal about an axis slightly behind the forward end of the treadle, the bellows supporting a rear portion of the treadle so that the bellows is compressed in response to the heel of the foot pressing down on the treadle.

2. The apparatus of claim 1 wherein said brush means includes a pair of mating, horizontally disposed brushes positioned in the housing beyond a forward end of the treadle to receive toes of the foot, at least one of said brushes being horizontally rotatable, said brushes being positioned so that the toes can be inserted through a gap between them, said gap being approximately horizontally aligned with the treadle.

3. The apparatus of claim 2 wherein said conduit includes a port positioned above both of said brushes and facing toward the rear of the treadle so that an unobstructed flow path is provided between the port and a foot on the treadle.

4. The apparatus of claim 3 further including a mat secured to the housing and extending from the bottom on both sides of the housing, said mat, on each side of the housing, being sufficiently large to enable a foot to be placed thereon, said mat having suction cups on the bottom thereof.

5. Foot cleaning apparatus comprising a housing for receiving the foot to be cleaned, a treadle in said housing on which the foot is adapted to be placed, means in said housing responsive to depression of the treadle for pressurizing a foot cleaning solution, means responsive to the solution being pressurized for dispensing the solution into the housing so that the dispensed solution is applied to the foot, and brush means in the housing for scrubbing the foot so that the dispensed cleaning solution is rubbed against the foot; said brush means includes a pair of mating, horizontally disposed brushes positioned in the housing beyond a forward end of the treadle to receive toes of the foot, at least one of said brushes being horizontally rotatable, said brushes being positioned so that the toes can be inserted through a gap between them, said gap being approximately horizontally aligned with the treadle.

6. The apparatus of claim 5 wherein said dispensing means includes a conduit having a port positioned above both of said brushes and facing toward the rear of the treadle so that an unobstructed flow path is provided between the port and a foot on the treadle.

* * * * *